US005169255A

United States Patent [19]

Jensen

[11] Patent Number: 5,169,255

[45] Date of Patent: Dec. 8, 1992

[54] METHOD AND APPARATUS FOR REMOVING SELECTED PAPERS FROM FILE FOLDERS

[76] Inventor: Daniel L. Jensen, 3751 Norris Canyon Rd., San Ramon, Calif. 94583

[21] Appl. No.: 654,384

[22] Filed: Feb. 11, 1991

[51] Int. Cl.[5] ..... B42F 13/42

[52] U.S. Cl. ..... 402/80 R; 402/500; 402/24; 402/25

[58] Field of Search ..... 402/24, 25, 80 R, 500

[56] References Cited

U.S. PATENT DOCUMENTS

| | | | |
|---|---|---|---|
| 923,325 | 6/1909 | Brown | 402/80 R |
| 1,202,831 | 10/1916 | Goslin | 402/80 R |
| 1,640,132 | 8/1927 | Miller | 402/80 R |
| 1,704,862 | 3/1929 | Lotter | 402/80 R |
| 1,894,137 | 1/1933 | Unger | 402/80 R X |
| 2,799,275 | 7/1957 | Darden | 402/80 R |
| 4,084,911 | 4/1978 | DeWitt | 402/80 R X |
| 4,632,586 | 12/1986 | Erickson | 402/80 R X |

*Primary Examiner*—Paul A. Bell
*Attorney, Agent, or Firm*—Schapp and Hatch

[57] ABSTRACT

What is disclosed is methods and apparatus for removing selected submerged sheets of paper from stacks of paper fastened in file folders by Acco-type fasteners. The apparatus is a superincumbent sheet remover consisting of a rigid plate having a paper clamp at one edge and notches on at least one edge for the prongs of the fastener which fastens the sheets of the stack in the file folder.

5 Claims, 5 Drawing Sheets

METHOD AND APPARATUS FOR REMOVING SELECTED PAPERS FROM FILE FOLDERS

BACKGROUND OF THE INVENTION

1. Field of the Invention

My invention relates to methods and apparatus for handling papers, and more particularly to methods and apparatus for removing selected, punched papers from file folders wherein they are secured by fasteners of the type sometimes called Acco fasteners.

2. Description of the Prior Art

The term "prior art" as used herein or in any statement made by or on behalf of applicant means only that any document or thing referred to as prior art bears, directly or inferentially, a date which is earlier than the effective filing date hereof.

It has been known for many years to retain papers in file folders by means of what are sometimes called Acco fasteners.

As is well known to those having ordinary skill in the art, an Acco fastener is comprised at least of an elongated member fabricated from thin, pliant, manually malleable or easily formable metallic material, which is generally called a "base" in the stationery trade. Such a base is generally divided into two outer portions, called "legs", or "prongs", and a somewhat wider central portion called the "body".

As is also well known, the method of using such a base consists in affixing the body thereof to a file folder, erecting the legs perpendicular to the body, passing the punchings in a plurality of sheets to be filed over the legs, and then bending the legs against the top sheet, thereby fastening these sheets into the folder.

As is well known in the art, the base may be fastened to the folder by passing its legs through two holes punched in a flap which is integral with the folder, with the legs disposed outwardly from the folder; or by adhering one face of the base body to the folder.

As is also well known, the sheets to be filed may be secured to the folder by simply turning the outer ends of the legs back against the top sheet, or the outer ends of the legs may be interengaged with a retaining device, sometimes called a "compressor", which bears upon the top sheet and is provided with sliding retainers for retaining the outer ends of the legs in interengagment with it.

While Acco-type fasteners have many advantages, and have found wide if not universal acceptance, their use gives rise to the problem of removing from a stack of papers fastened in a file folder by an Acco-type fastener one or more selected papers which are located within the stack, and then restoring to the stack the papers originally located above the selected papers (called herein the "superincumbent" or "overlying" papers or sheets). This problem is greater, of course, when the selected papers are at or near the bottom of the stack. This problem will herein be called the "submerged sheet removal problem".

Many expedients have been adopted in an attempt to solve the submerged sheet removal problem, such as the expedient of inserting a reverse-positioned base into the aligned holes in the sheets of the stack after first erecting the legs of the fastener, raising the superincumbent sheets onto the reverse-positioned base, lifting off the superincumbent sheets and the reverse-positioned base, lifting off the selected sheets, realigning and reinserting the reverse-positioned base, returning the superincumbent papers to the stack, and removing the reverse-positioned base.

Devices are found in the prior art which address the submerged sheet removal problem, such as a device which includes a pair of tubes which are passed over the fastener base legs, whereby the superincumbent sheets can be lifted onto the tubes for removal from the base legs with their holes remaining in alignment Such devices are disclosed in U.S. Pat. Nos. 4,084,911 and 4,632,586, copies of which are supplied to the United States Patent and Trademark Office herewith.

Prior art submerged sheet removal devices sold under the trademarks Copyclip, TIP-CLIP, Easiclip, and DocuClip are shown and described in the copies of advertising literature supplied to the Patent and Trademark Office herewith.

Such prior art expedients and devices, however, generally require that an element of a superincumbent sheet removal device be aligned with and then engaged with each base leg of the fastener in order to install the device.

Further, such prior art expedients and devices in general require that the superincumbent sheets be manipulated as a group onto the superincumbent sheet removal device after installing the superincumbent sheet removal device.

Yet further, such prior art expedients and devices in general require the realignment and reengagement of said elements with the fastener base legs, i.e., the reinstallation of the superincumbent sheet removal device, when the superincumbent sheets are returned to the file folder.

Further still, these prior art expedients and devices in general involve the manipulation of the superincumbent sheets as a group in order to return them from the superincumbent sheet removal device to their position on top of the remainder of the stack when the superincumbent sheets are returned to the file folder.

It is believed that the United States patents listed immediately below, which were adduced by an independently made prior art search, contain information which is or might be construed to be material to the examination of this patent application.

| U.S. Pat. No. | Inventor |
|---|---|
| 3,190,642 | W. Smith |
| 3,476,360 | R. Renfroe |
| 3,996,667 | G. Barnard |
| 4,462,736 | C. Jenkins |

No representation or admission is made that any of the above-listed patents or other documents is part of the prior art, or that no more pertinent information exists.

SUMMARY OF THE INVENTION

Accordingly, it is an object of my invention to provide methods and apparatus for rapidly and easily removing superincumbent sheets of paper from a selected sheet or sheets fastened in a file folder by means of an Acco-type fastener, whereby to rapidly and easily gain access to the selected sheet or sheets for immediate removal from the file folder.

A further object of my invention is to provide superincumbent sheet removal apparatus for rapidly and easily removing superincumbent sheets of paper from a selected sheet or sheets fastened in a file folder by means of an Acco-type fastener, which apparatus makes it unnecessary to manipulate the superincumbent sheets onto the apparatus after installing the apparatus in the stack of papers in the file folder.

A yet further object of my invention is to provide superincumbent sheet removal apparatus which need not be reinstalled when returning the superincumbent sheets to the file folder.

Another object of my invention is to provide superincumbent sheet removal apparatus for rapidly and easily removing superincumbent sheets of paper from a selected sheet or sheets fastened in a file folder by means of an Acco-type fastener, no part of which apparatus must be aligned with the outer ends of the legs of the fastener when removing the superincumbent sheets.

A yet further object of my invention is to provide superincumbent sheet removal apparatus for rapidly and easily removing superincumbent sheets of paper from a selected sheet or sheets fastened in a file folder by means of an Acco-type fastener, no part of which apparatus must be fed into the aligned holes of the sheets of paper fastened in said file folder by said fastener.

An additional object of my invention is to provide superincumbent sheet removal apparatus for rapidly and easily removing superincumbent sheets of paper from a selected sheet or sheets fastened in a file folder by means of an Acco-type fastener, no part of which apparatus must be reinserted into the aligned holes of the sheets remaining on the legs of said fastener after the removal therefrom of said superincumbent sheets and said selected sheet or sheets.

Yet another object of my invention is to provide superincumbent sheet removal apparatus for rapidly and easily removing superincumbent sheets of paper from a selected sheet or sheets fastened in a file folder by means of an Acco-type fastener, which apparatus maintains the holes in said superincumbent sheets in alignment without at any time passing any alignment member therethrough other than the legs of said fastener.

Other objects of my invention will in part be obvious and will in part appear hereinafter.

My invention, accordingly, comprises the several steps and the relation of one or more such steps with respect to each of the others, and the apparatus embodying features of construction, combinations of elements, and arrangements of parts which are adapted to effect such steps, all as exemplified in the following disclosure, and the scope of my invention will be indicated in the appended claims.

In accordance with a principal feature of my invention, apparatus is provided for rapidly and easily removing superincumbent sheets of paper from a selected sheet or sheets fastened in a file folder by means of an Acco-type fastener, which apparatus includes a substantially rigid plate member adapted to underlie and support the superincumbent sheets while they are removed from and returned to the fastener.

In accordance with another principal feature of my invention said plate is provided with a clamp whereby to secure the superincumbent sheets to said plate with their punchings in alignment during the removal of the superincumbent sheets from the fastener and during the restoration of the superincumbent sheets to the fastener.

In accordance with an additional principal feature of my invention a plurality of notches are provided in at least one side of said plate, a pair of said notches being so located that when one edge of a sheet of paper punched with base prong receiving holes bears against said clamp the notches of said pair are aligned with said holes.

In accordance with a yet further principal feature of my invention such notches are provided on the two sides of said plate adjacent the side to which said clamp is affixed.

In accordance with another principal feature of my invention such notches are provided on the side of said plate opposite said clamp.

In accordance with yet another principal feature of my invention the method thereof comprises the steps of (1) erecting the legs of said fastener, (2) raising at least the ends of said superincumbent sheets remote from said fastener, and (3) inserting said plate between said superincumbent sheets and said selected sheet or sheets.

In accordance with a yet further principal feature of my invention the method of my invention further comprises the steps of (1) opening said clamp (2), translating said plate parallel to the base of said fastener until the base of said clamp contacts one edge of said superincumbent sheets, (3) translating said plate upward, i.e., toward said fastener, until the legs of the fastener are located in two of said notches, and (4) clamping said superincumbent sheets to said plate by means of said clamp.

In accordance with another principal feature of my invention the method thereof further comprises the steps of (1) lifting said plate from said folder and thereby removing said superincumbent sheets from the legs of the fastener, (2) removing the selected sheet or sheets from the legs of the fastener, (3) passing the aligned holes of the superincumbent sheets clamped to said plate over the legs of said fastener until said plate lies upon said remaining sheets, (4) opening said clamp, and (5) removing said plate from beneath said superincumbent sheets.

For a fuller understanding of the nature and objects of my invention, reference should be had to the following detailed description, taken in connection with the accompanying drawings.

DESCRIPTION OF THE PREFERRED EMBODIMENTS

Figure 1:
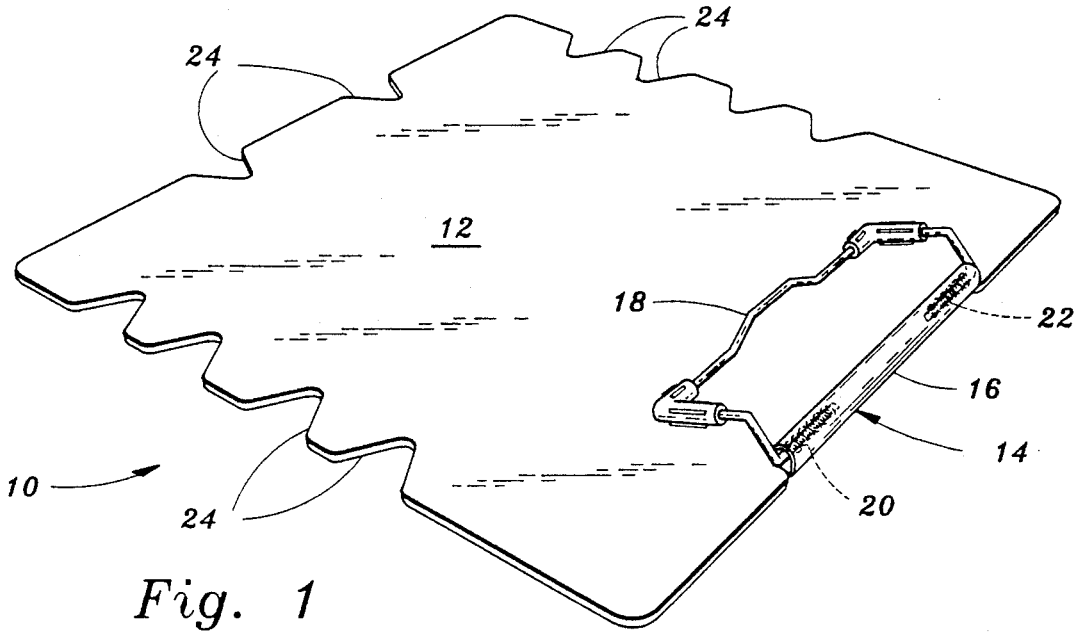
FIG. 1 is a perspective view of a superincumbent sheet removing apparatus embodying my invention.

Referring now to FIG. 1, there is shown a superincumbent sheet removal device or sheet remover 10 constructed in accordance with the first preferred embodiment of my invention.

As seen in FIG. 1, sheet remover 10 is comprised of a flat plate 12 to one edge of which is affixed a paper clamp 14 of well known type by means of which one or a stack of sheets of paper may be clamped to plate 12.

In the well known manner, paper clamp 14 is comprised of a body portion 16, which is immovably affixed to plate 12, and a pivotally movable jaw portion 18 the inner ends of which are received in the upper tubular portion of body portion 16, whereby jaw 18 is pivotable about the axis of the tubular portion of body portion 16.

Also in the well known manner, a pair of springs 20, 22 are provided within the tubular portion of clamp body portion 16, whereby jaw 18 of clamp 14 is resiliently biased toward the top of plate 12.

As further seen in FIG. 1, notches 24 are provided on the three edges of plate 12 remote from paper clamp 14.

The size and distribution of the notches 24 in the plate of the superincumbent sheet remover of the first preferred embodiment of my invention are set out in detail hereinbelow in connection with FIG. 3.

In the first preferred embodiment of my invention, plate 12 is fabricated from sheet aluminum, thus providing a plate which is rigid yet light in weight. It is to be understood, however, that my invention is not limited to the employment of an aluminum plate, nor to the employment of a metalic plate. To the contrary, the plates of the sheet removers of certain embodiments of my invention may be fabricated from filled plastics, fiberboard, or any other material which is suitably light, rigid, and thin.

Further, it is to be understood that my invention is not limited to the employment of the particular paper clamp shown in FIG. 1. Rather, it is to be understood that a wide variety of well known paper clamps may be employed in fabricating superincumbent sheet removal devices embodying my invention.

Figure 2:
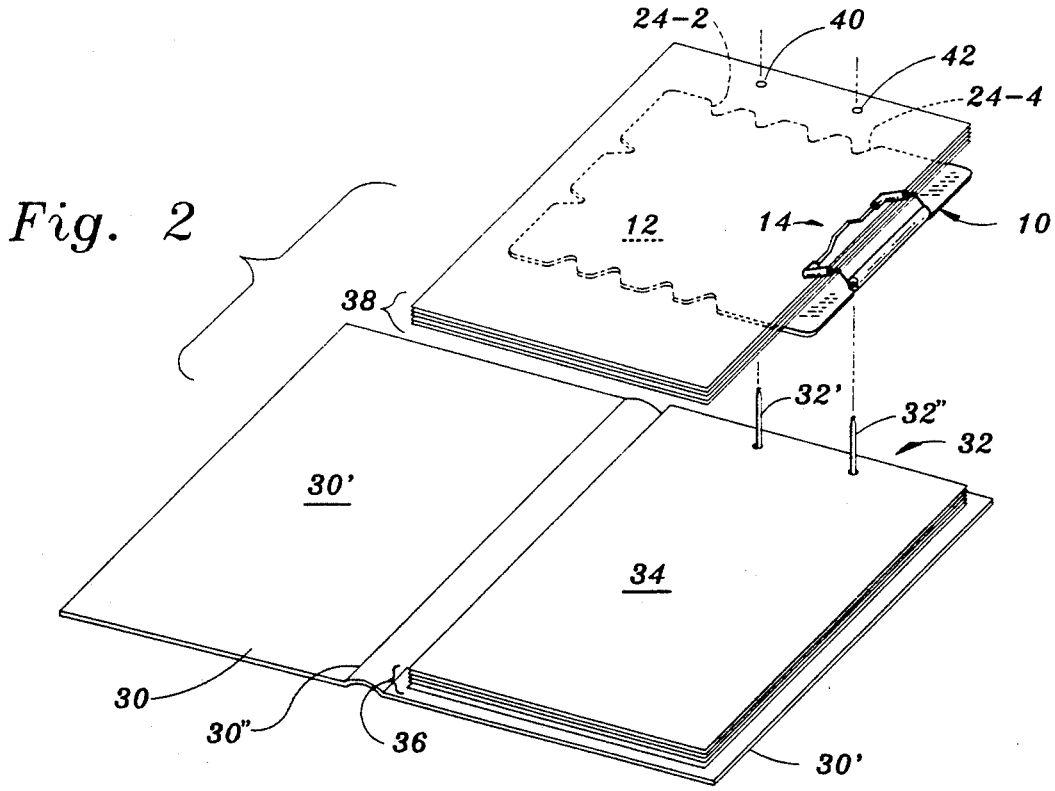
FIG. 2 is an exploded perspective view showing a file folder of well known type from which a stack of superincumbent sheets has been removed by means of a superincumbent sheet removal device of my invention.

Referring now to FIG. 2, there is shown a file folder 30 of well known type in which is affixed an Acco-type fastener 32, shown only in part.

As will be evident to those having ordinary skill in the art, informed by the present disclosure, the parts of fastener 32 actually shown in FIG. 2 are its two prongs or legs 32', 32".

As will also be evident to those having ordinary skill in the art, file folder 30 is comprised of two panels 30', 30" which are parts of a single sheet of a material sometimes called "tag" in the stationery trade and are separately defined by a hinge crease or fold 30'".

My invention applies to file folders of many different types, such as the well-known triple panel file folder found commonly in law offices.

As is also well known to those having ordinary skill in the art, it is a common practice to affix a plurality of such fasteners to various panels of such file folders.

As further seen in FIG. 2, a plurality of sheets of paper 34, 36 are disposed in file folder 30, each sheet having a pair of punchings in the respective ones of which prongs 32', 32" are received.

It is to be understood that the single sheet 34 is the sheet which has been selected for removal from file folder 30, and that the plurality of sheets 36 are those designated by the terminology used herein as remaining sheets.

As further seen in FIG. 2, a plurality 38 of sheets are disposed above sheet 34, with all of their punchings in alignment with prongs 32', 32". Sheets 38, as seen in FIG. 2, are superincumbent sheets, as that term is used herein.

As further seen in FIG. 2, superincumbent sheets 38 are supported on a superincumbent sheet removal device or sheet remover 10 constructed in accordance with the first preferred embodiment of my invention, and shown in FIG. 1.

As also seen in FIG. 2, superincumbent sheets 38 are clamped to the plate 12 of sheet remover 10 by paper clamp 14, and thus the punchings 40, 42 in sheets 38, are maintained in alignment by the action of clamp 14.

It will thus be seen by those having ordinary skill in the art, informed by the present disclosure, that upon the removal of selected sheet 34 sheet remover 10 and superincumbent sheets 38 can be directly lowered so that prongs 32', 32"pass through the aligned punched holes 40, 42 in all of the superincumbent sheets 38, restoring all of the superincumbent sheets 38 to fastener 32 in one motion.

As also seen in FIG. 2, the two common axes of the punched holes 40, 42 pass through two notches 24–2, 24–4 in the upper edge of plate 12.

Figure 3:
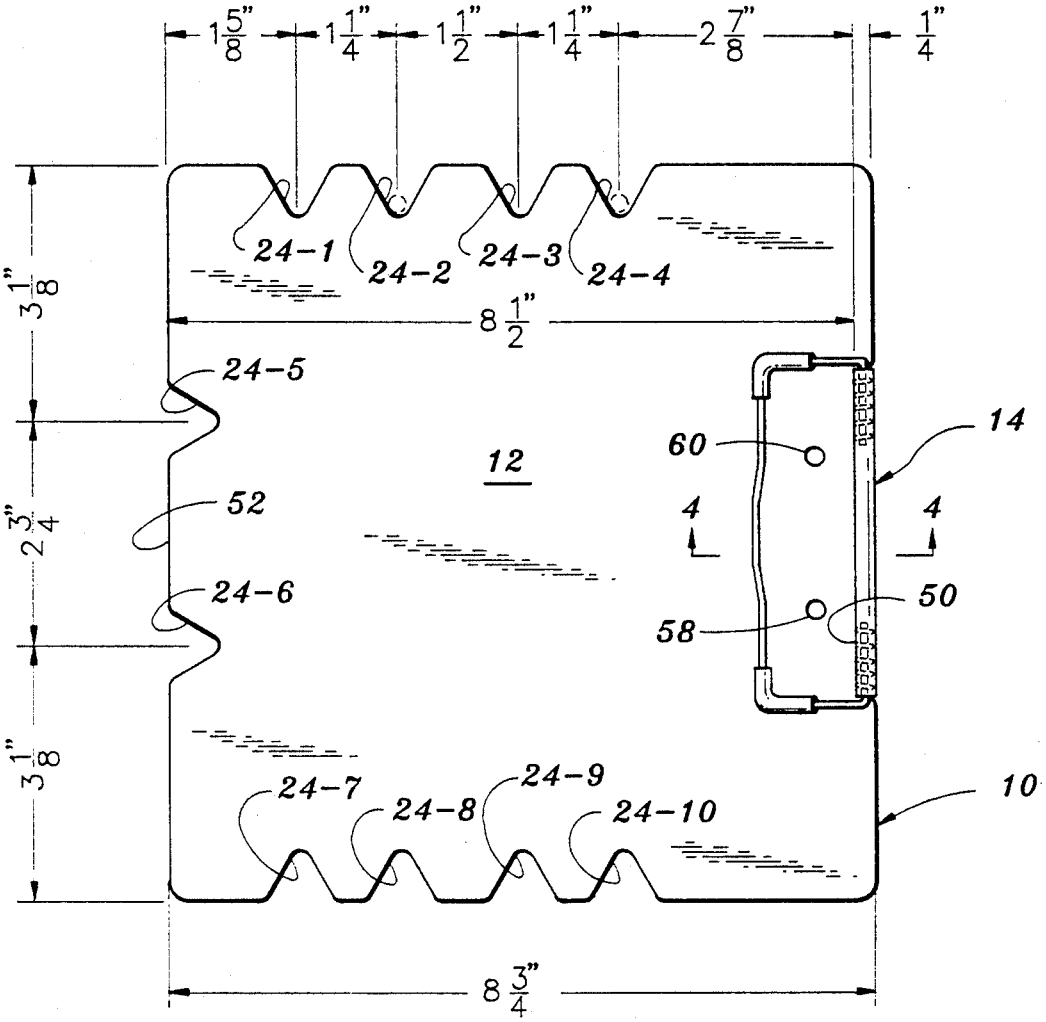
FIG. 3 is a plan view of a superincumbent sheet removal device of my invention, showing a preferred pattern of fastener leg receiving notches and the location of each of these notches with respect to the clamp portion of the device.

Referring now to FIG. 3, there is shown a plan view of the superincumbent sheet removal device or sheet remover 10 of the first preferred embodiment of my invention, and particularly the dimensions of the sheet remover of the first preferred embodiment of my invention. It is to be understood, however, that my invention is not limited in scope to either the sheet remover configuration or the sheet remover dimensions given in FIG. 3.

It is to be particularly noted that the dimension of the device of the first preferred embodiment extending from the bearing face 50 of paper clamp 14 to the opposite edge 52 of plate 12 is $8\frac{1}{2}$ inches.

It is also to be noted that, for clarity of discussion, the ten notches in the edge of plate 12 are particularly designated by the respected hypenated reference designations 24–1 through 24–10.

Thus, it will be seen in FIG. 3 that in the first preferred embodiment of my invention the distance between the bottoms of the notches 24–2 and 24–4 is $2\frac{3}{4}$ inches, which is the standard distance between the prongs or legs of a variety of widely used Acco-type fasteners.

Similarly, the distance between the bottoms or inner ends of notches 24-1 and 24-3 is $2\frac{3}{4}$ inches, and the distance between the bottoms of notches 24-5 and 24-6 is $2\frac{3}{4}$ inches.

It is to be understood that the disposition of the notches along the lower edge of plate 12 is the same as the disposition of the notches along the upper edge of plate 12.

Thus, both notches 24-1 and 24-7 are located $1\frac{5}{8}$ inches from edge 52 of plate 12; notches 24-7 and 24-8 are interspaced by $1\frac{1}{4}$ inches as are notches 24-1 and 24-2; etc.

It will thus be seen that notch 24-1 may be seen to be paired with notch 24-7; notch 24-2 may be seen to be paired with notch 24-8; notch 24-3 may be seen to be paired with 24-9; and notch 24-4 may be seen to be paired with notch 24-10; in the sense that both notches of each pair are equidistant from edge 52 of plate 12.

Figure 4:
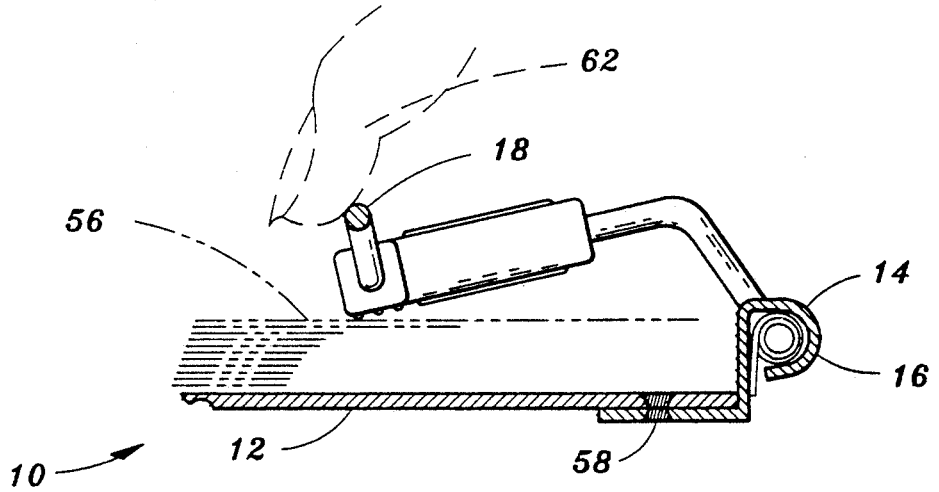
FIG. 4 is a partial sectional view in elevation of the superincumbent sheet removal device of my invention shown in FIG. 3, taken on plane 4-4 of FIG. 3 and showing a preferred form of clamp.

Referring now to FIG. 4, there is shown in partial sectional view, along plane 4-4 of FIG. 3, the details of paper clamp 14 and its cooperative relationship with plate 12 and a stack of papers 56 disposed on plate 12.

As seen in FIG. 4, the body 16 of paper clamp 14 is secured to plate 12 by a suitable rivet 58, and a second rivet 60 (FIG. 3).

As also seen in FIG. 4, body 16 contains a coil spring 20 (along with another coil spring 22 shown in FIG. 1), which coil springs strongly resiliently bias the bail or arms and crossbar 18 of paper clamp 14 against the upper surface of plate 12, or against a stack of papers 56 disposed thereupon.

It is to be understood that the amount of force by which bail 18 is thus resiliently urged against plate 12 or paper stack 56 is not so large that it cannot be overcome by the thumb 62 of a user, whereby to release paper stack 56.

While paper clamp 14 is not provided with detenting means whereby bail 18 is caused to remain in a non-clamping position remote from plate 12 when operated into that position, the employment of such detented paper clamps falls within the scope of my invention.

METHOD

Referring now to FIGS. 5 through 9, the use of the sheet remover device of the first preferred embodiment of my invention will now be described in detail.

The file folder shown in FIGS. 5 through 9 is similar in all respects to the file folder shown in FIG. 2 and thus the same reference numerals relating to the file folder, the fastener, and the papers shown in FIG. 2 are also used in FIGS. 5 through 9, with the exception of the fact that only a single remaining paper 66 is shown in FIGS. 5 through 9.

Figure 5:
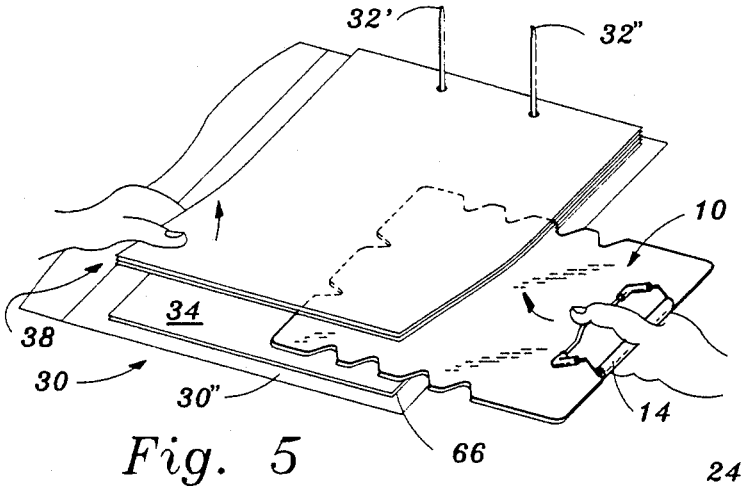
FIGS. 5 through 9 illustrate a series of steps of the method of my invention for removing selected submerged sheets from a stack of sheets of paper fastened in a file folder by means of an Acco-type fastener.

As seen in FIG. 5, the first steps of the method of my invention consist in (1) erecting fastener prongs 32', 32''; (2) manually raising superincumbent papers 38 from selected paper 34; (3) and inserting superincumbent sheet remover 10 between superincumbent sheets 38 and selected sheet 34.

Figure 6:
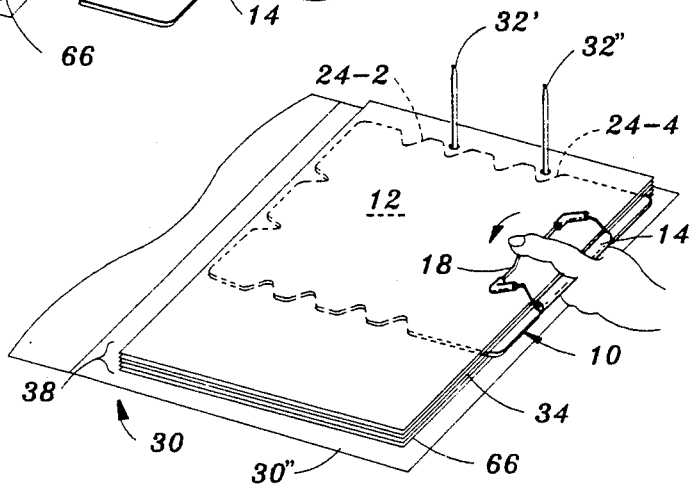

As seen in FIG. 6, the next steps of the method of my invention consist in (4) translating sheet remover 10 leftwardly until the bearing face of paper clamp 14 bears against the right-hand edge of superincumbent sheets 38; (5) translating sheet remover 10 upwardly, i.e., toward prongs 32', 32'', until these respective prongs are received in notches 24-2, 24-4; and (6) manually releasing bail 18 so that superincumbent sheets 38 are clamped to plate 12 of sheet removal device 10.

Figure 7:
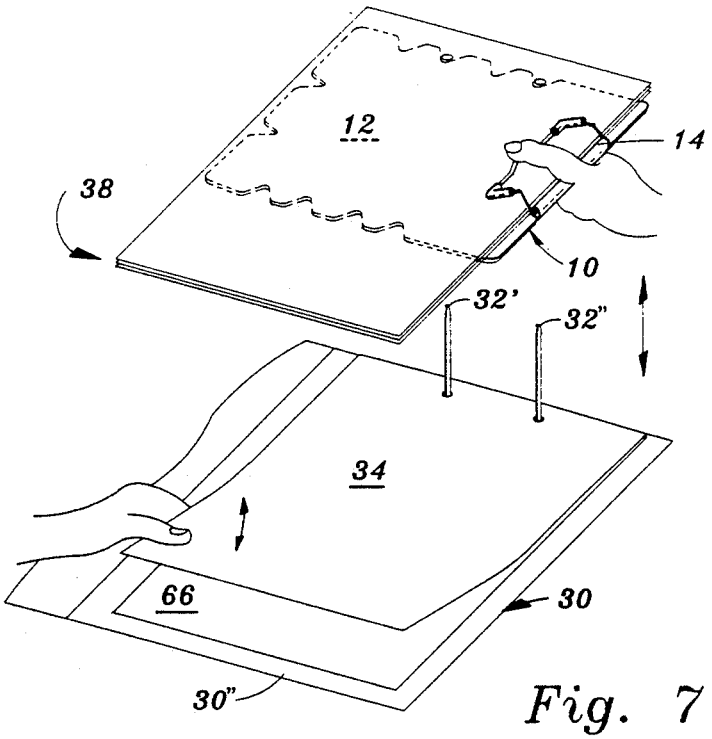

As seen in FIG. 7, the next steps of the method of my invention consist in (7) raising sheet remover 10 from folder 30 so that superincumbent sheets 38 are together withdrawn from prongs 32', 32'', their punchings remaining in alignment; and (8) manually removing selected sheet 34 from prongs 32', 32''.

Figure 8:
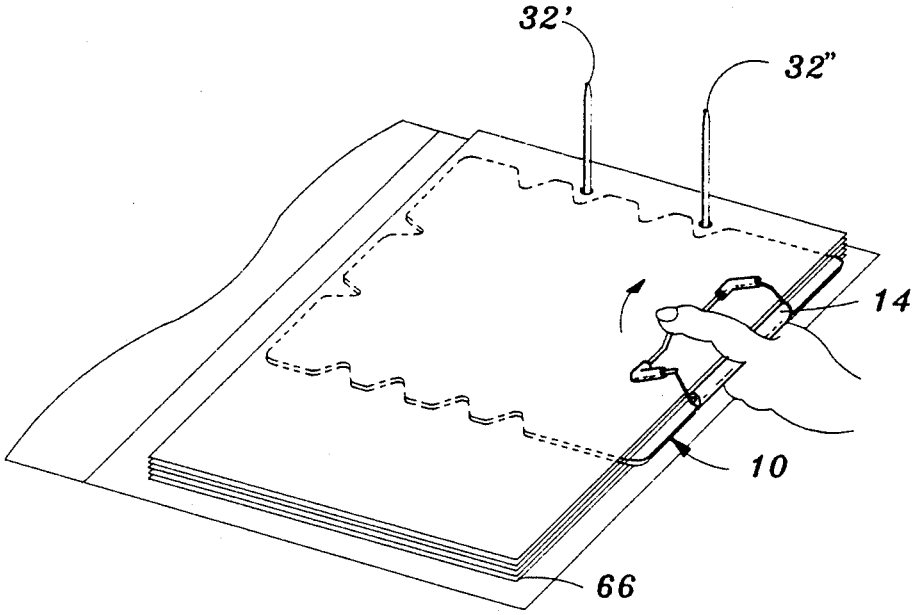

As then seen in FIG. 8, the next steps of the method of my invention are (9) lowering sheet remover 10 and superincumbent sheets 38 clamped thereon so that prongs 32', 32''pass upward through the punchings in superincumbent sheets 38; and (10) manually opening paper clamp 14 to release superincumbent sheets 38.

Figure 9:
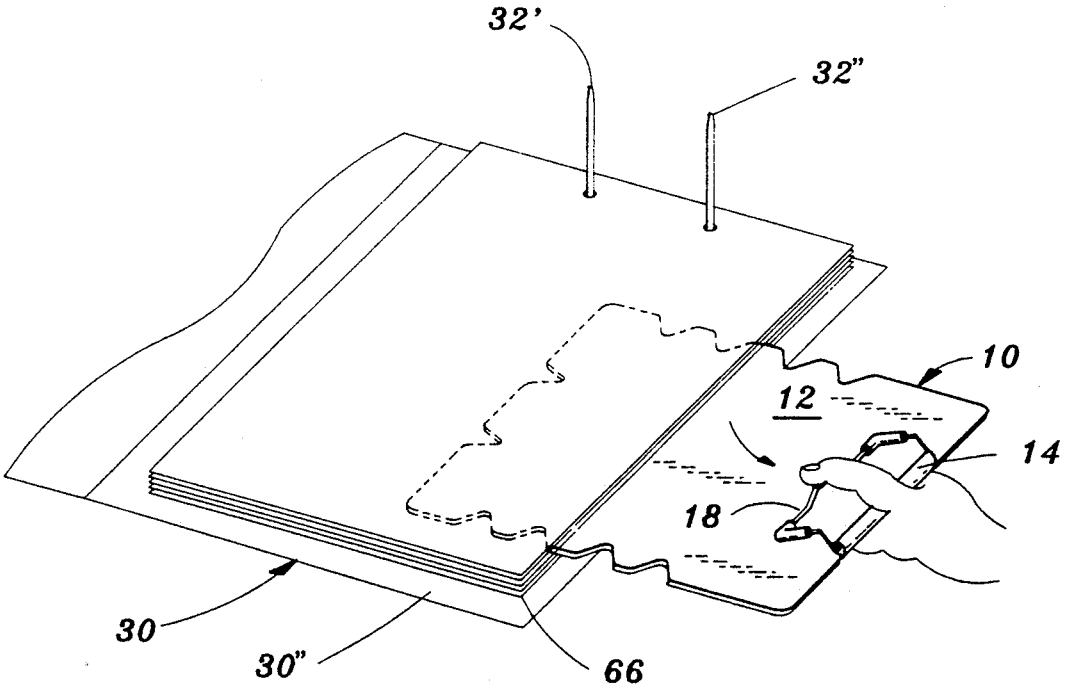

As seen in FIG. 9, the last step (11) of the method of my invention is the withdrawal of sheet remover 10 from between superincumbent sheets 38 and remaining sheet 66.

After the removal of sheet remover 10, and the manual release of bail 18, prongs 32', 32''will be manually turned against the upper face of the top sheet, engaged with a compressor or otherwise; whereupon all of the sheets but the selected sheet are secured to file folder 30 by engagement with prongs 32', 32''.

Figure 10:
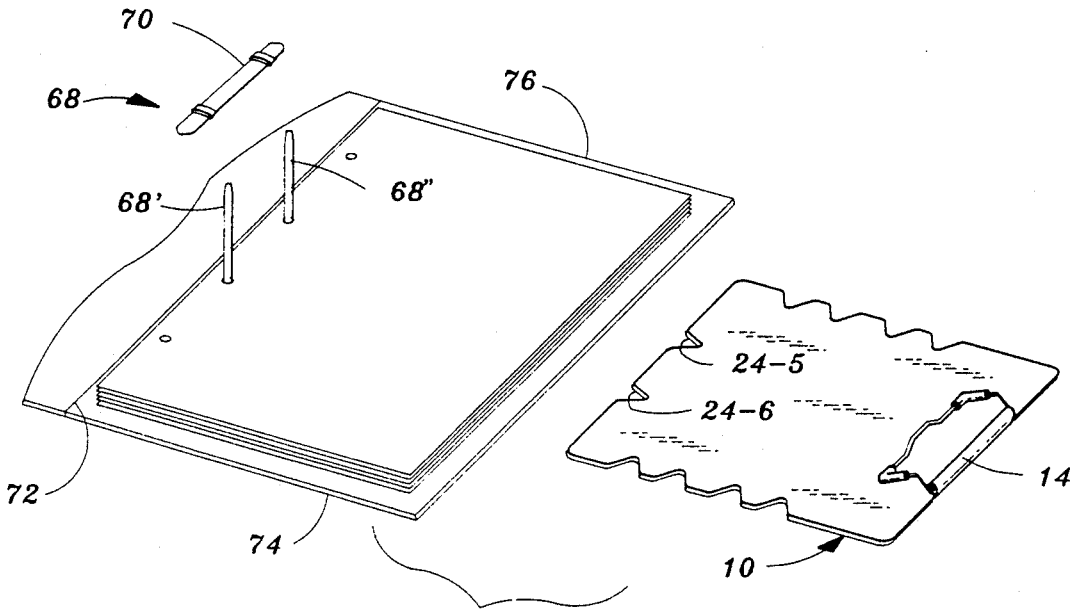
FIG. 10 is a partial perspective view of an alternative form of file folder and the mode of cooperation therewith of the superincumbent sheet removal device of the first preferred embodiment of my invention.

Referring now to FIG. 10, there is shown the method of using superincumbent sheet remover 10 of the first preferred embodiment of my invention in connection with another file folder arrangement wherein an Acco-type fastener 68 is located near the center of the hinge crease of a file folder 74, rather than adjacent the center of the upper edge 76 of the right-hand panel of file folder 74.

The method of employing sheet remover 10 in connection with this type of file folder is similar to the method of my invention shown in FIGS. 5 through 9, except that after raising the superincumbent sheets and inserting sheet remover 10 between the superincumbent sheets and the selected sheet or sheets, sheet remover 10 is translated crosswise of the major dimension of file folder 74 until prongs 68', 68'' are seated in notches 24-5, 24-6, and the bearing face of paper clamp 14 bears against the opposite edges of the superincumbent sheets.

As with the method shown and described in connection with FIGS. 5 through 9, prongs 68', 68'' must first be erected, and a compressor 70 removed if one is used. After the removal of the selected sheet or sheets, the restoration of the superincumbent sheets by means of sheet remover 10, and the withdrawal of sheet remover 10, prongs 68', 68'' must be turned over the upper sheet, with or without compressor 70.

Figure 11:
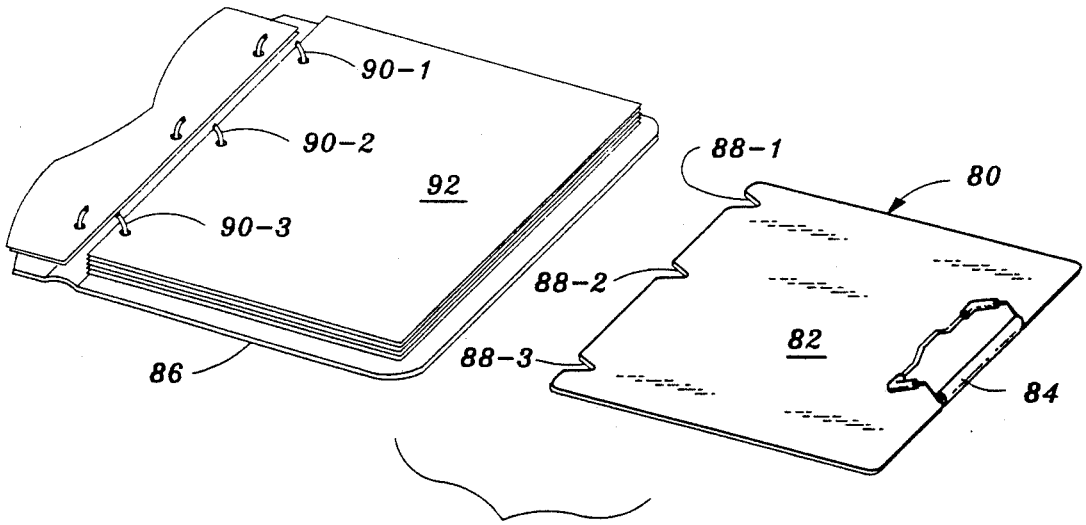
FIG. 11 is a partial perspective view of a loose-leaf notebook and a perspective view of an embodiment of the apparatus of my invention especially adapted for use with looseleaf notebooks.

Referring now to FIG. 11, there is shown an alternate embodiment of my invention which is designed for use in connection with loose-leaf notebooks and the papers bound therein.

As seen in FIG. 11, sheet remover 80 of this embodiment of my invention consists of a rigid plate 82, which may be fabricated from the same material as plate 12 of the first preferred embodiment of my invention.

As also seen in FIG. 11, rigid plate 82 is provided with a paper clamp 84 which may be substantially identical to paper clamp 14 of the sheet remover of the first preferred embodiment of my invention.

Plate 82 differs from plate 12 of the first preferred embodiment in that it is of different shape, its length and width being substantially equal to the length and width of the sheets of binder paper bound in the loose-leaf notebook 86 shown in FIG. 11.

Plate 82 also differs from plate 12 in that it is provided with but three notches, 88-1, 88-2, 88-3, which notches are of such depth and so located so as to embrace the rings 90-1, 90-2, 90-3 of looseleaf notebook 86 when plate 82 is passed beneath a plurality of superincumbent sheets until the bearing face of clamp 84 contacts the outer edge of those superincumbent sheets 92, as shown in FIG. 11.

It will thus be seen that the objects set forth above, among those made apparent from the preceeding description, are efficiently attained, and since certain changes may be made in the above constructions and the method carried out thereby without departing from the scope of my invention, it is intended that all matter contained in the above description or shown in the accompanying drawings shall be interpreted as illustrative only, and not in a limiting sense.

This, it is to be understood that the superincumbent sheet removers of my invention may take many different forms, all within the scope of my invention. For example, an embodiment of my invention may be provided in which the plate is of substantially the same shape as one of the standard ledger sheets used in bookkeeping and generally maintained in a post binder of well known type, in which case the notches provided on the edge of the plate opposite the paper clamp will be of such shape and size as to accomodate the well known extensible post found in such post binders.

It is also to be understood that the following claims are intended to cover all of the generic and specific features of my invention hereindescribed, and all statements of the scope of my invention which, as a matter of language, might be said to fall therebetween.

What is claimed is:

1. The method of utilizing a plate member having a paper clamp affixed thereto adjacent one edge thereof for removing a selected sheet or sheets of pater from beneath one or more superincumbent sheets, allow which sheets are fastened in a file folder by a fastener having a plurality of manually malleable prongs, which prongs pass through holes punched in each of said sheets, comprising the steps of:

erecting said prongs;

grasping said plate member at said paper clamp with one hand and inserting said plate member between said selected sheet or sheets and said one or more superincumbent sheets so that an edge of said plate member other than said one edge confronts said prongs; and operating said paper clamp with said one hand to clamp said superincumbent sheets to said plate member;

removing said plate member and said superincumbent sheets from said prongs; and removing said selected sheet or sheets from said prongs.

2. The method claimed in claim 1 in which said plate member is provided at said edge other than said one edge with notches for receiving said prongs, further comprising the step of translating said plate member between said selected sheet or sheets and said one or more superincumbent sheets until said prongs are received in said notches.

3. A paper stack remover for removing the overlying stack of sheets of paper from a selected sheet of paper in a file folder in which a plurality of sheets of paper are fastened by a fastener having a plurality of manually malleable prongs, which prongs pass through holes punched in each of said sheets of paper adjacent in edge thereof, comprising:

a planar, substantially rigid plate member having a generally rectilinear shape;

a paper clamp affixed to said plate member at a first side thereof for clamping said overlying stack of sheets of paper to said plate member;

at least one of the other sides of said plate member having a plurality of notches formed therein for receiving said prongs when said plate member is disposed beneath said overlying stack of sheets and said paper clamp bears against said overlying stack of sheets; and a limit stop for limiting the entry of said overlying stack of sheets of paper into said paper clamp.

4. A paper stack remover as claimed in claim 3 in which said limit stop is integral with said paper clamp.

5. A paper stack remover for removing the overlying stack of sheets of paper from a selected sheet of paper in a file folder in which a plurality of sheets of paper are fastened by a fastener having a plurality of manually malleable prongs, which prongs pass through holes punched in each of said sheets of paper adjacent an edge thereof, comprising:

a planar, substantially rigid plate member having a generally rectilinear shape;

a paper clamping jaw confronting said plate member at a first side thereof for clamping said overlying stack of sheets of paper to said plate member;

pivot means for pivotably mounting said paper clamping jaw on said plate member;

spring means for resiliently biasing said paper clamping jaw against said overlying stack of sheets of paper;

manually operable means for withdrawing said paper clamping jaw from said plate member against the urging of said spring means to permit the insertion of said overlying stack of papers under said clamping jaw;

at least one of the other sides of said plate member having a plurality of notches formed therein for receiving said prongs when said plate member is disposed beneath said overlying stack of sheets and said paper clamp bears against said overlying stack of sheets; and limit stop means for limiting the extent to which said overlying stack of sheets of paper can pass between said plate member and said paper clamping jaw.

* * * * *